US005466571A

United States Patent [19]

Mitsuhashi et al.

[11] Patent Number: 5,466,571

[45] Date of Patent: Nov. 14, 1995

[54] SILVER HALIDE PHOTOGRAPHIC LIGHT-SENSITIVE MATERIAL

[75] Inventors: Tsuyoshi Mitsuhashi; Nobuaki Kagawa, both of Hino, Japan

[73] Assignee: Konica Corporation, Japan

[21] Appl. No.: 420,626

[22] Filed: Apr. 12, 1995

Related U.S. Application Data

[63] Continuation of Ser. No. 223,286, Apr. 5, 1994, abandoned.

[30] Foreign Application Priority Data

Apr. 14, 1993 [JP] Japan ..... 5-087394

[51] Int. Cl.[6] ..... G03C 1/08; G03C 1/22

[52] U.S. Cl. ..... 430/578; 430/591; 430/592; 430/601; 430/603

[58] Field of Search ..... 430/603, 572, 430/573, 574, 576, 578, 591, 592, 593, 575, 601

[56] References Cited

U.S. PATENT DOCUMENTS

| | | | |
|---|---|---|---|
| 5,112,733 | 5/1992 | Ihama | 430/603 |
| 5,116,722 | 5/1992 | Callant et al. | 430/578 |
| 5,158,892 | 10/1992 | Sasaki | 430/603 |
| 5,236,821 | 8/1993 | Yagihara | 430/603 |
| 5,238,807 | 8/1993 | Sasaki | 430/603 |

FOREIGN PATENT DOCUMENTS

| | | | |
|---|---|---|---|
| 0540295 | 5/1993 | European Pat. Off. | 430/593 |
| 100347 | 4/1993 | Japan | 430/593 |
| 0677409 | 5/1991 | Switzerland | 430/591 |
| 212749 | 12/1966 | U.S.S.R. | 430/578 |

*Primary Examiner*—Lee C. Wright

*Attorney, Agent, or Firm*—Jordan B. Bierman; Bierman and Muserlian

[57] ABSTRACT

A silver halide photographic light-sensitive material is disclosed which comprises a support and provided thereon, a light-sensitive silver halide emulsion layer containing silver halide grains, the silver halide grains are chemically sensitized by a selenium compound and spectrally sensitized by a dye represented by formula (S-1):

formula (S-1)

11 Claims, No Drawings

SILVER HALIDE PHOTOGRAPHIC LIGHT-SENSITIVE MATERIAL

This application is a continuation, of application No. 08/223,286, filed Apr. 5, 1994, now abandoned.

FIELD OF THE INVENTION

The present invention relates to a silver halide photographic light-sensitive material high in the spectral sensitivity in a red-light wavelength region, excellent in a latent-image stability after exposure and improved in the prevention of a residual-color stain.

BACKGROUND OF THE INVENTION

A means for widening a light-sensitive wavelength region of a silver halide emulsion and making a sensitivity higher has been well-known as a spectral sensitization technique. As for spectrally sensitizing dyes applicable to satisfy the purpose of the above-mentioned technique, a great number of compounds such as a cyanine dye and a merocyanine dye have been known so far.

Such a spectrally sensitizing dye as mentioned above has to widen the light-sensitive wavelength region of a silver halide emulsion and satisfy the various requirements such as given below.

1) A spectrally sensitizing region is to be suitable;

2) A spectrally sensitizing efficiency is to be high;

3) A fog production, a gamma variation and/or the like are not to affect photographic characteristic curves;

4) Photographic characteristics such as fogginess are not to be varied when aging a silver halide photographic light-sensitive material containing a sensitizing dye (particularly when preserving it under the conditions of a high temperature and a high humidity.);

5) Any color contamination is not to be produced by diffusion of a sensitizing dye in one layer to another layer having any different sensitive wavelength region; and 6) After completing each of developing, fixing and washing step, a light-sensitive dye is washed off and any color stain is not to be produced off.

However, any spectrally sensitizing dyes having so far been disclosed still have been unable to reach a level fully satisfying the above-mentioned requirements.

Further, recently the film processing speed has entered into a super-rapid mass-processing age, and diagnostic equipments such as a CT and an MRT are each used in a process for exclusive use directly connected to a photographing equipment. In the case of a super-rapid processing (for not longer than 45 seconds) and in the case of a small amount of replenishing a developing chemical, a further improvement of processability has been demanded, because a residual color has been liable to produce.

The known light-sensitive dyes effectively capable of spectrally sensitizing a red-light wavelength region include, for example; a complex cyanine dye and a complex merocyanine dye disclosed in Belgian Patent No. 541,245, U.S. Pat. Nos. 2,493,747, 2,743,272 and 3,335,010, French Patent No. 2,113,248 and German Patent Nos. 1,024,800, 2,153,570 and 2,300,321 and Japanese Patent Publication Open to Public Inspection (hereinafter referred to as JP OPI Publication) No. 3-171135/1991; a cyanine dye disclosed in JP O.P.I. Publication Nos. 49-11121/1974, 51-33622/1976, 51-115821/1976, 51-115822/1976, 58-72937/1983, 61-203446/1986, 2-256045/1990 and 3-15042/1991; a merocyanine dye disclosed in U.S. Pat. Nos. 2,493,747, 2,493,748 and 2,519,001 and JP OPI Publication Nos. 51-106422/1976 and 59-214030/1984. In some part of these dyes, a residual color stain has been tried to reduce it by introducing a water-solublilizing group into the molecules thereof, however, there have still been such a problem that the reduction of the residual color stains have not been satisfactory, or that a sensitivity variation has been liable to occur when lowering a spectrally sensitized sensitivity or when aging a coating solution and, therefore, the dyes have still not been satisfied.

The dyes described in European Patent Nos. 363,104 and 363,107 have also been proved to display the effect of improving a residual color stain. However, when aging a light-sensitive material spectrally sensitized by making use of these dyes, there has raised such a problem that the photographic characteristics thereof are varied.

JP OPI Publication Nos. 54-18726/1979, 59-135461/1984 and 62-246045/1987 disclosed each such a technique that a spectral sensitivity is enhanced and a residual color stain is reduced by making use of the above-mentioned dye and a supersensitizer in combination. However, these techniques have still been on an unsatisfiable level and, therefore, a further improvement has been demanded.

In recent years, the following means has been getting popularized, in which an image digital or video signal for radiation-diagnostic use such as MRI, X-ray CT and digital X-ray diagnoses is taken in and then processed, and the resulting processed signal is expressed imagewise on a silver halide photographic light-sensitive material by scanning with a laser beam, so that the image is served as a transparent image so as to perform a diagnosis.

In a recording system in which a laser beam is used, an image quality has been made high as a semiconductive laser has been getting popularized and it has, therefore, been demanded for a silver halide photographic light-sensitive material for laser-beam source use, which is high in sensitivity and stable in characteristics in aging. At present, in addition to the above, there have demanded for a silver halide photographic light-sensitive material for laser-beam source use having stable characteristics each compatible to the range from a 630 nm light-source typified by a conventional He-Ne laser to a 680–650 nm semiconductive laser having recently been put in practical use.

However, with a light-sensitive material spectrally sensitized by a conventional red-sensitizing dye, a resulting image density is varied by the difference of time between a point of time when an exposure is made and a point of time when a development is made. The image density variation is produced because a latent image produced by exposure is not stable (that is, the progression and regression of a latent image are relatively great). Therefore, a handling convenience is worsened from an exposure through a development.

In the recording systems in which the above-mentioned laser-beam source is used, the period or the environment during from the point of time when making an exposure to the point of time when making a development are different between a system in which a laser-imager and an automatic processor are directly connected together and another system in which a laser-imager and an automatic processor are separately arranged to each other. Therefore, the difference results in a density variation which is problematic.

SUMMARY OF THE INVENTION

It is, accordingly, an object of the invention is to provide a silver halide photographic light-sensitive material enhancing the spectral sensitivity in a red light wavelength region, excellent in a latent image stability after making an exposure and improved in a residual color stain prevention.

The above-mentioned problems were solved in the present invention of which will be summarized below.

The invention was achieved with a silver halide photographic light-sensitive material comprising a support and provided thereon, a light-sensitive silver halide emulsion layer containing silver halide grains, wherein said silver halide grains are chemically sensitized by a selenium compound and spectrally sensitized by a dye represented by formula (S-I):

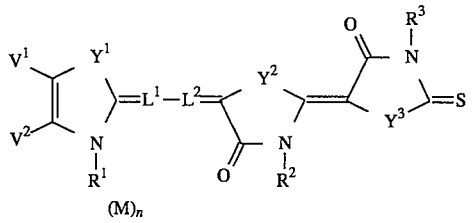

(S-I)

wherein $y^1$, $y^2$ and $y^3$ independently represent an —N(R)-group, an oxygen atom, a sulfur atom or a selenium atom; $R^1$ represents an aliphatic group with a water-solubilizing group having not more than 10 carbon atoms; R, $R^2$ and $R^3$ represent each an aliphatic group, an aryl group or a heterocyclic group, provided that at least two groups of R, $R^2$ and $R^3$ each have a water-solubilizing group; $V^1$ and $V^2$ represent each a hydrogen atom, an alkyl group, an alkoxy group, an aryl group or a group capable of forming a condensed ring together with an azole ring upon bonding thereto with $V^1$ and $V^2$; $L^1$ and $L^2$ independently represent a substituted or unsubstituted methine group;

M represents an ion necessary for canceling the total charge of the molecule; and n is a number necessary for neutralizing a charge of the molecule.

DETAILED DESCRIPTION OF THE INVENTION

Now, the invention will further be detailed below.

In the compounds represented by the above-given Formula (S-I), the water-solubilizing group which to R, $R^1$, $R^2$, and $R^3$ have include, for example, each of acid groups such as a sulfo group, a carboxy group, a phosphono group, a sulfate group and a sulfino group.

The aliphatic groups represented by R, $R^1$, $R^2$ and $R^3$ include, for example, a branch-chained or straight-chained alkyl group having 1 to 10 carbon atoms (such as methyl, ethyl, n-propyl, n-pentyl or isobutyl), an alkenyl group having 3 to 10 carbon atoms (such as 3-butenyl or 2-propenyl) or an aralkyl group having 7 to 10 carbon atoms (such as each group of benzyl or phenetyl). The aryl groups represented by R, $R^2$ and $R^3$ include, for example, a phenyl group. The heterocyclic groups include, for example, a pyridyl group (2-, 4-), a furyl group (2-), a thienyl group (2-), a sulfolanyl group, a tetrahydrofuryl group and a piperidinyl group. Each of the groups represented by R, $R^1$, $R^2$ and $R^3$ may also be substituted with each of the substituents including, for example, a halogen atom (such as a fluorine atom, a chlorine atom or a bromine atom), an alkoxy group (such as a methoxy group or an ethoxy group), an aryloxy group (such as a phenoxy group or a p-tolyloxy group), a cyano group, a carbamoyl group (such as a carbamoyl group, an N-methylcarbamoyl group, or an N,N-tetramethylenecarbamoyl group), a sulfamoyl group (such as a sulfamoyl group or an N,N-3-oxapentamethyleneaminosulfonyl group), a methanesulfonyl group, an alkoxycarbonyl group (such as an ethoxycarbonyl group or a butoxycarbonyl group), an aryl group (such as a phenyl group or a carboxyphenyl group), and an acyl group (such as an acetyl group or a benzoyl group).

The typical examples of the aliphatic groups substituted each with a water-solubilizing group include carboxymethyl, sulfoethyl, sulfopropyl, sulfobutyl, sulfopentyl, 2-sulfobutyl, 6-sulfo-3-oxahexyl, ω-sulfopropoxycarbonylmethyl, ω-sulfopropylaminocarbonylmethyl, 3-sulfinobutyl, 3-phosphonopropyl, 4-sulfo-3-butenyl, 2-carboxy-2-propenyl, O-sulfobenzyl, P-sulfophenethyl and p-carboxybenzyl.

The typical examples of the aryl groups substituted each with a water-solubilizing group include each of a p-sulfophenyl group and a p-carboxyphenyl group. The typical examples of the heterocyclic groups substituted each with a water-solubilizing group include each of a 4-sulfothienyl group and a 5-carboxypyridyl group. In the above-given groups, it is preferable that $R^1$ represents an alkyl group substituted with a sulfo group and at least two groups of the groups represented by R, $R^2$ and $R^3$ represent each a carboxymethyl group.

The alkyl groups represented by $V^1$ and $V^2$ include, for example, a straight-chained or branch-chained group (such as each group of methyl, ethyl, iso-propyl, t-butyl, iso-butyl, t-pentyl and hexyl). The alkoxy groups represented by $V^1$ and $V^2$ include, for example, each group of methoxy, ethoxy and propoxy.

The aryl groups represented by $V^1$ and $V^2$ may also have a substituent in any position, and the aryl groups include, for example, each group of phenyl, p-tolyl, p-hydroxyphenyl and p-methoxyphenyl.

As for the condensed rings formed each together with an azole ring upon bonding of $V^1$ and $V^2$ to each other, they include, for example, such a condensed ring as those of benzoxazole, 4,5,6,7-tetrahydrobenzoxazole, naphtho[1,2-d] oxazole, naphtho [2,3-d]oxazole, benzothiazole, 4,5,6,7-tetrahydrobenzothiazole, naphtho [1,2 -d]thiazole, naphtho [2,3-d]thiazole, benzoselenazole and naphtho [1,2-d]selenazole. In the above-mentioned group or condensed ring formed represented by $V^1$ and $V^2$, there may also be a substituent in any position. The substituents include, any one of the following substituents, namely, a halogen atom (such as a fluorine atom, a chlorine atom, a bromine atom and a iodine atom), a trifluoromethyl group, an alkoxy group (such as each of unsubstituted alkyl groups, e.g., those of methoxy, ethoxy and butoxy, and each of substituted alkoxy groups, e.g., those of 2-methoxyethoxy and benzyloxy), a hydroxy group, a cyano group, an aryloxy group (such as each of substituted or unsubstituted groups, e.g., those of phenoxy and tolyloxy), or an aryl group (such as each of substituted or unsubstituted groups, e.g., those of phenyl and p-chlorophenyl), a styryl group, a heterocyclic group (such as each group of furyl and a thienyl), a carbamoyl group (such as each group of carbamoyl and N-ethylcarbamoyl), a sulfamoyl group (such as each group of sulfamoyl and N,N-dimethylsulfamoyl), an acylamino group (such as each group of acetylamino, propionylamino and benzoylamino), an acyl group (such as each group of acetyl and benzoyl), an alkoxycarbonyl group (such as an ethoxycarbonyl group), a sulfonamido group (such as each group of methanesulfonylamido and benzenesulfonamido), a sulfonyl group (such as each group of methanesulfonyl and p-toluenesulfonyl) and a carboxy group.

The substituents of the methine carbon represented by $L^1$ and $L^2$ include, for example, a lower alkyl group (such as each group of methyl and ethyl), a phenyl group (such as each group of phenyl and carboxyphenyl) and an alkoxy group (such as each group of methoxy and ethoxy).

M represents a cation or an artion. The typical examples of the cations include, for example, an organic ammonium ion (such as each ion of triethyl ammonium and triethanol ammonium) and an inorganic ion (such as each cation of lithium, sodium and calcium). The typical examples of the anion include, for example, a halogen ion (such as ion of chlorine, bromine and iodine), a p-toluene sulfonic acid ion, a perchloric acid ion and a tetrafluoroboron ion.

The number of n depends on the number of a water-solubilizing group of dye molecule, and is preferably 0 to 2.

When an intramolecular salt is formed to neutralize a charge, n becomes 0.

The typical example of the sensitizing dyes represented by Formula IS-I] will be given below. However, the sensitizing dyes thereof shall not be limited to the compounds given below.

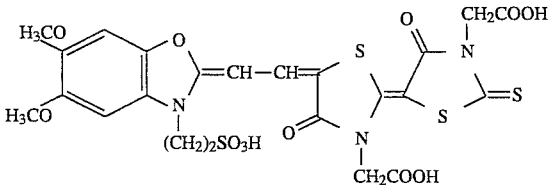
S-1

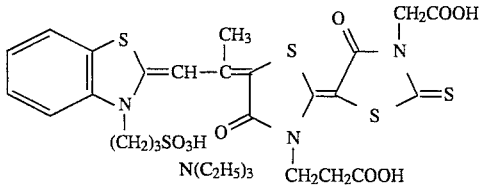
S-2

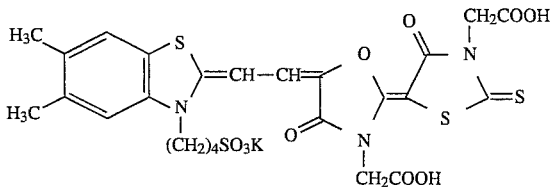
S-3

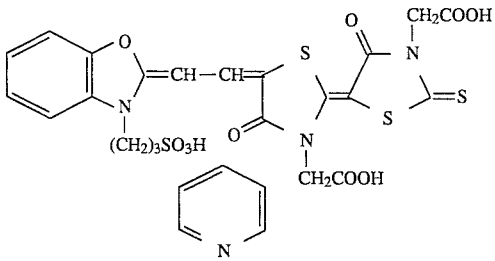
S-4

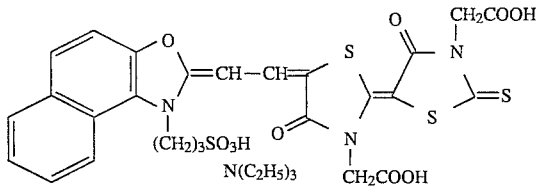
S-5

-continued

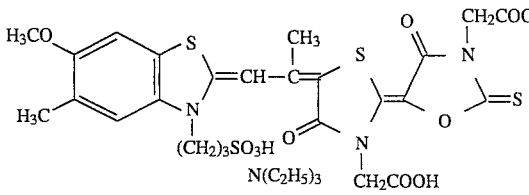
S-6

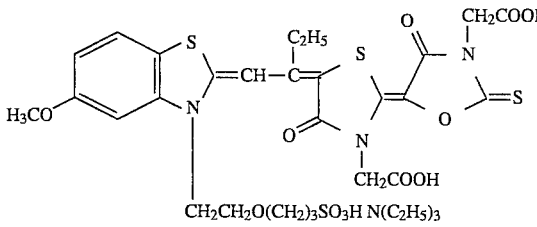
S-7

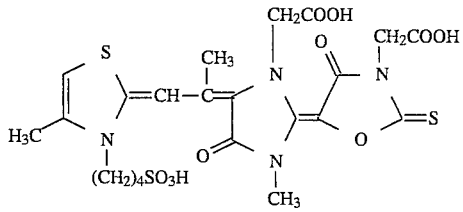
S-8

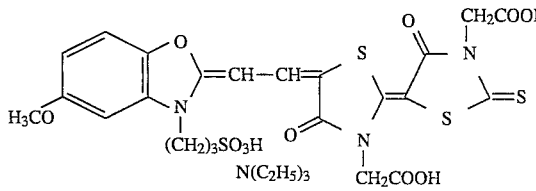
S-9

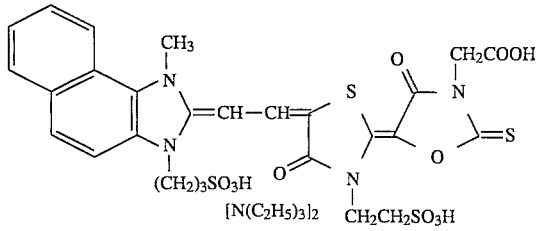
S-10

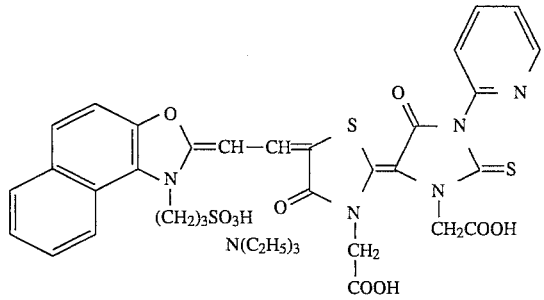
S-11

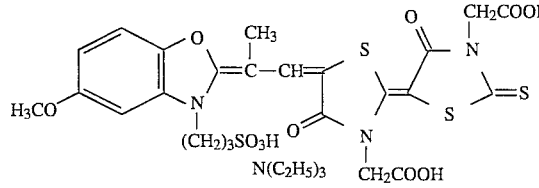
S-12

-continued
S-13
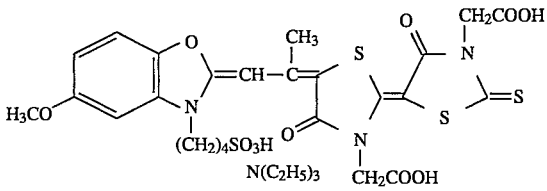
S-14
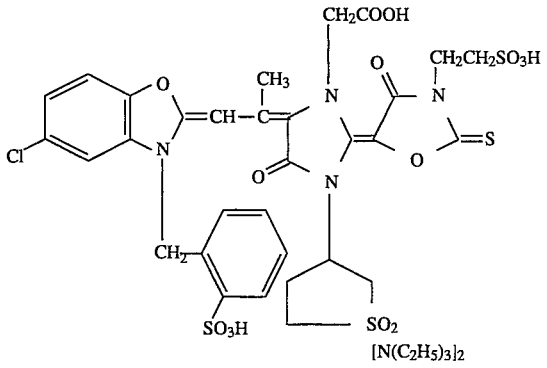
S-15
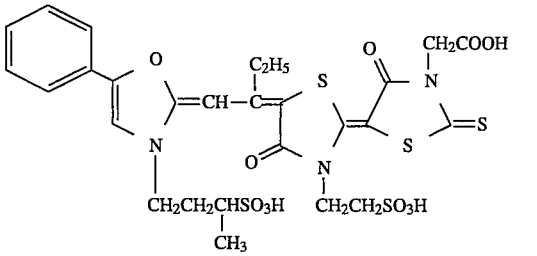
S-16
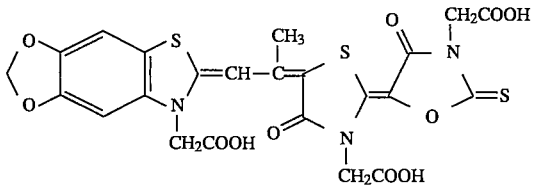
S-17
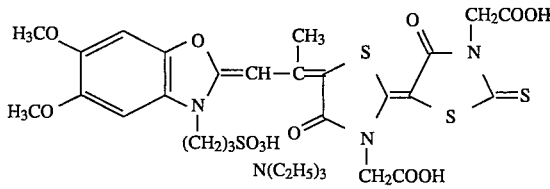
S-18
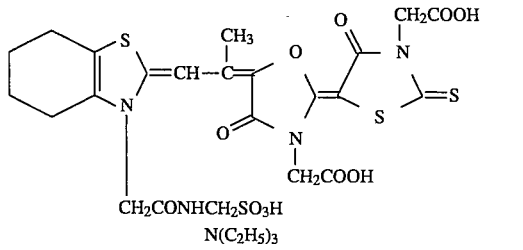
S-19
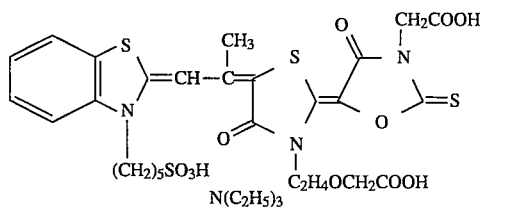
-continued
S-20
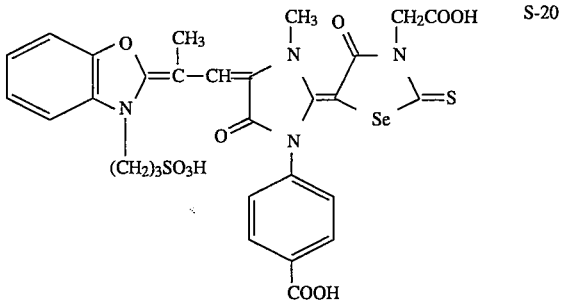
S-21
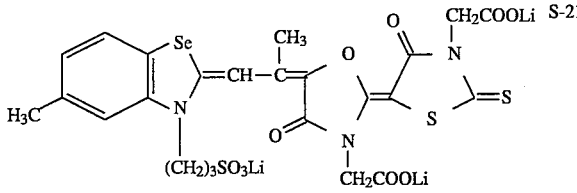
S-22
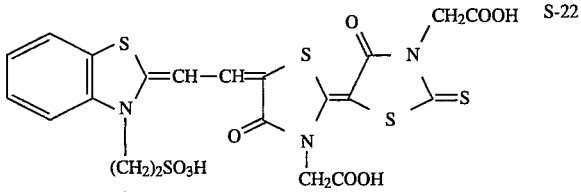
S-23
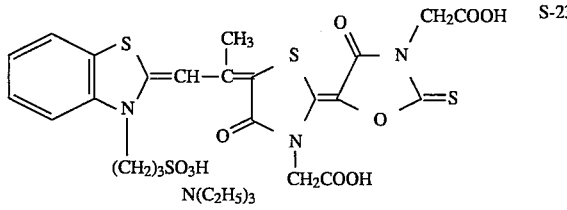
S-24
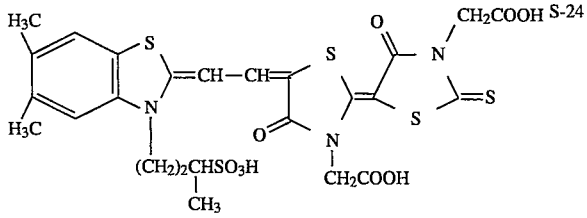
S-25
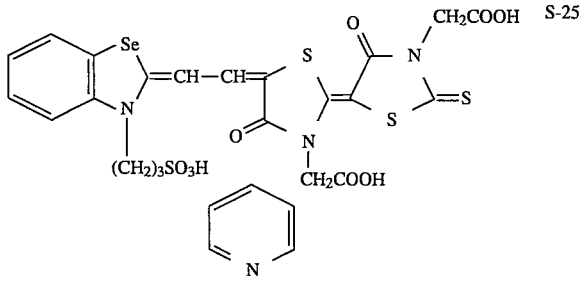
S-26
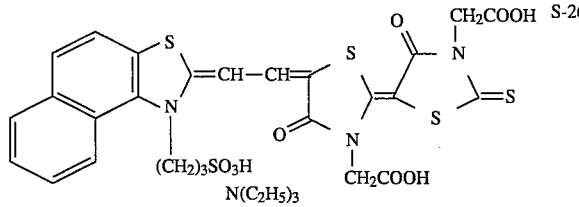

-continued

S-27

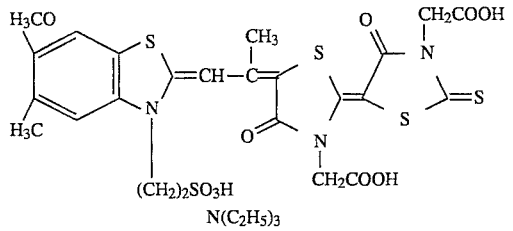

S-28

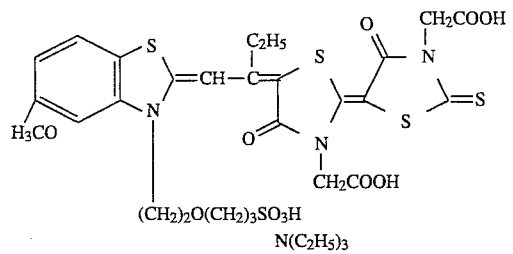

S-29

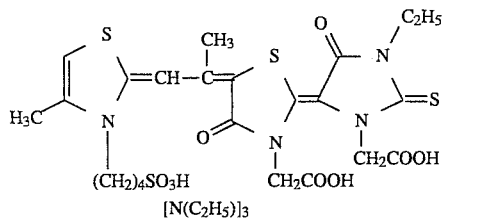

S-30

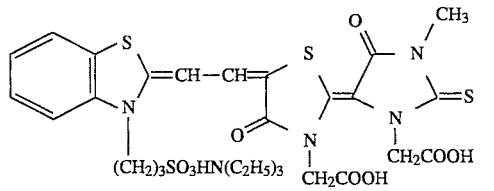

S-31

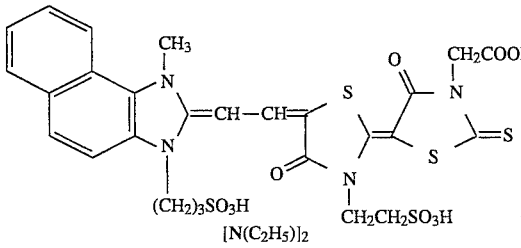

S-32

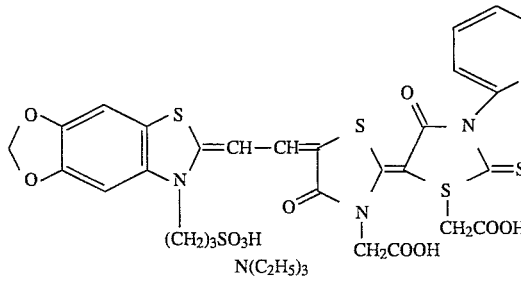

S-33

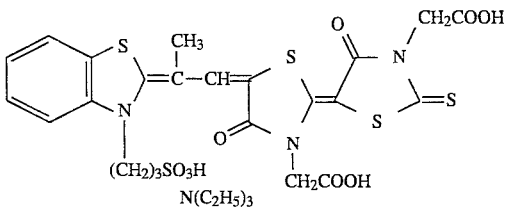

-continued

S-34

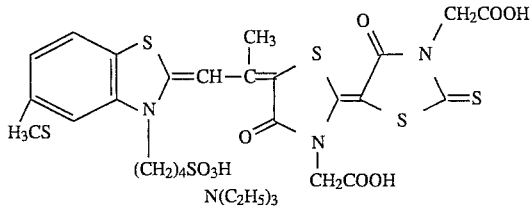

S-35

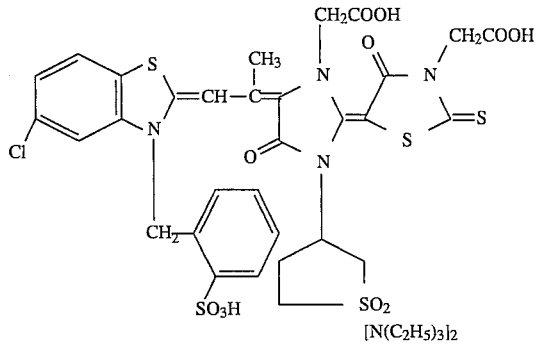

The above-given compounds of the invention can readily be synthesized with reference to a conventionally known process such as those described in F. M. Harmer, "Cyanine Dyes and Related Compounds", Inter-Science Publishers Co., 1964; and U.S. Pat. Nos. 2,454,629 and 2,493,748.

Now, the typical synthesization examples thereof will be given below. However, the other exemplified compounds may also be synthesized in the similar processes.

Synthesization example (of Exemplified Compound S-9)

Both of 2.43 g of 4-oxo-5-[2-[5-methoxy- 3-(3-sulfopropyl)-2(3H)-benzoxazoyllidene]ethylidene]- 2-thioxothiazolidine-3-yl acetic acid and 5.6 g of p-toluenesutfonic acid methyl ester were mixed up together and the resulting mixture thereof was stirred with heating at 130° C. for 120 minutes. The temperature of the stirred mixture was cooled down to room temperature. The resulting viscous reactant was added with isopropyl ether and the mixture thereof was stirred and then allowed to stand. Thereafter, the supernatant was so tilted out as to be removed. Thereto, 1 g of 4-oxo-2-thioxothiazolidine-3-yl acetic acid was added. Successively, 3 ml of pyridine was further added and the resulting mixture thereof was moderately refluxed by heating for 20 minutes. Thereafter, it was so cooled down as to be crystallized. The resulting precipitates were filtrated out and were then washed with ethanol.

The resulting crude crystals were recrystallized from a methanol solvent, and the yield was 1.1 g. The absorption maximum wavelength was proved to be 547 nm in the methanol solvent.

The amount of the dye of the invention to be added is varied, in dependence greatly on the conditions of using a subject compound and various kinds of emulsions. However, it is to be added in an amount within the range of, preferably, $1\times10^{-6}$ to $5\times10^{-3}$ mols per mol of silver halide used and, more preferably, $2\times10^{-6}$ to $2\times10^{-3}$ mols.

A compound represented by Formula [S-I], which can be used in the invention, may be added to a silver halide emulsion in any conventionally known process. The processes include, for example; a protonation-dissolution-addition process such as those described in JP OPI Publication Nos. 50- 80826/1975 and 50-80827/1975; a dispersion-addition process in which a surfactant is used in combination such as those described in U.S. Pat. No. 3,822,135 and JP OPI Publication No. 50-11419/1975; a process in which a dispersion and an addition are made to a hydrophilic substance such as those described in U.S. Pat. Nos. 3,676,147, 3,469,987 and 4,247,627 and JP OPI Publication Nos. 51-59942/1976, 53- 16624/1978, 53-102732/1978, 53-102733/1978 and 53-137131/1978; a process in which an addition is made in the form of a solid solution such as those described in East German Patent No. 143,324; or a process in which a dye is added upon dissolving it to an independent water-solubilizing solvent or to the combination thereof (including, for example, a low-boiling solvent such as water, methanol, ethanol, propyl alcohol, acetone and fluorinated alcohol, and a high-boiling solvent such as dimethyl formamide, methyl cellosolve and phenyl cellosolve). Any processes such as those given above may be selectively used.

The compound of the invention represented by the foregoing formula may be added at any time in the course of carrying out an emulsion preparation process from a physical ripening step to a coating step through a chemical ripening step interposed therebetween. It is, however, preferable to add it at a point of time between a physical ripening step and the completion of a chemical ripening step.

In the course of carrying out a physical ripening step or in a chemical ripening step, when the compound of the invention is added in advance of adding a chemical sensitizer or immediately after adding a chemical sensitizer, the compound of the invention is preferably used, because a higher spectral sensitivity can be obtained.

The sensitizing dye represented by formula (S-I) may also be used together with the other sensitizing dye in combination. In this case, each of light-sensitive dyes may be added to an emulsion at the same time together or by installments at different times separately. In the latter case, the order and time intervals of adding them may freely be determined so as to meet the objects of the application.

The dye represented by formula (S-I), which is applicable to the invention, can provide a further higher spectral sensitivity when making use of a compound capable of endowing a super color-sensitization in combination. Such a compound capable of displaying a super color-sensitization as mentioned above include, for example; a compound having a pyrimidinylamino group or a triazinylamino group such as those described in U.S. Pat. Nos. 2,933,390, 3,416,927, 3,511,664, 3,615,613, 3,615,632 and 3,635,721 and Jp OPI Publication Nos. 3-15042/1991, 3-110545/1991 and 4-255841/1992; an aromatic organic formaldehyde condensate such as those described in British Patent No. 1,137,580 and JP OPI Publication Nos. 61- 169833/1986; a calixarene derivative disclosed in JP OPI Publication No. 4-184332/1992; a halogenated benzotriazole derivative such as those described in U.S. Pat. No. 4,030,927; a bispyridinium compound such as those described in JP OPI Publication Nos. 59-142541/1984 and 59-188641/1984; an aromatic heterocyclic quaternary salt compound such as those described in JP OPI Publication No. 59-191032/1984; an electron-donatable compound such as those described in JP OPI Publication No. 60-79348/1985; a polymer containing an aminoallylidene malononitrile unit such as those described in U.S. Pat. No. 4,307,183; a hydroxytetrazaindene derivative such as those described in JP OPI Publication No. 4- 149937/1992, a 1,3-oxadiazole derivative such as those described in U.S. Pat. No. 3,615,633; and an amino-1,2,3,4-thiatriazole derivative such as those described in U.S. Pat. No. 4,780,404.

The time for adding these super color-sensitizers shall not specially be limited, but they can be added any time so as to meet the time for adding a light-sensitive dye. They may selectively be added in an amount within the range of $1\times10^{-6}$ to $1\times10^{-1}$ mols per mol of silver halide used. They may be used, with a sensitizing dye, in an adding mol-ratio within the range of 1:10 to 10:1.

Now, a selenium compound will be detailed below.

As for a selenium sensitizer applicable to the invention, any one having been disclosed in the conventionally known patents can be used. A selenium sensitization is commonly carried out by adding an unstable type selenium compound and/or a non-unstable type selenium compound each to a silver halide emulsion and the emulsion is then stirred at a high temperature and, preferably, a temperature of not lower than 40° C. for a specific time. As for an unstable type selenium compound, it is preferable to use a compound such as those described in JP Examined Publication Nos. 44-15748/1969 and 43-13489/1968. The typical unstable type selenium sensitizers include, for example, an isoselenocyanate (such as an aliphatic isoselenocyanate, e.g., allylisoselenocyanate) a selenourea, a selenoketone, a selenoamide, a selenocarboxylic acid (such as 2-selenopropionic acid and 2-selenobutyric acid), a selenoester, a diacylselenide (such as bis(3-chloro- 2,6-dimethoxybenzoyl)selenide), a selenophosphate, a phosphine selenide and a colloidal metal selenium.

A non-unstable type selenium compound applicable to the invention include, for example, a compound described in JP Examine Publication Nos. 46-4553/1971, 52-34492/1977 and 52-34491/1977. A non-unstable type selenium compound include, for example, selenious acid, potassium selenocyanide, a selenazole, a quaternary salt of a selenazole, a diaryl selenide, a diaryl diselenide, a dialkyl selenide, a dialkyl diselenide, 2-selenazolidinedione, 2-selenoxazolidinethione and the derivatives thereof.

Among the selenium compounds, those represented by the following formulas (1) and (2) may preferably be used.

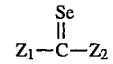

Formula (1)

wherein $Z_1$ and $Z_2$ may be the same with or the different from each other and represent each an alkyl group (such as a methyl, ethyl, t-butyl, adamantyl or t-octyl group), an alkenyl group (such as a vinyl or propenyl group), an aralkyl group (such as a benzyl or phenethyl group), an aryl group (such as a phenyl, pentafluorophenyl, 4-chlorophenyl, 3-nitrophenyl, 4-octylsulfamoylphenyl or an α-naphthyl group), a heterocyclic group (such as a pyridyl, thienyl, furyl or imidazolyl group), $—NR_1(R_2)$, $—OR_3$ or $—SR_4$.

$R_1$, $R_2$, $R_3$ and $R_4$ may be the same with or the different from each other and represent each an alkyl group, an aralkyl group, an aryl group or a heterocyclic group. The alkyl group, aralkyl group, aryl group or heterocyclic group may include the same examples with those of $Z_1$. However, $R_1$ and $R_2$ may also represent each a hydrogen atom or an acyl group such as acetyl, propanoyl, benzoyl, heptafluorobutanoyl, difluoroacetyl, 4-nitrobenzoyl, a-naphthoyl or 4-trifluoromethylbenzoyl.

In formula (1), $Z_1$ preferably represents an alkyl group, an aryl group or $—N(R_1)(R_2)$, and $Z_2$ represents $—N(R_1)(R_2)$. $R_1$ and $R_2$ may be the same with or the different from each other and represent each a hydrogen atom, an alkyl group, an aryl group or an acyl group.

In formula (1), the compound is more preferably a N,N-dialkylselenourea, a N,N,N'-trialkyl-N'-acylselenourea, a tetralkylselenourea, an N,N-dialkyl-arylselenoamide or an N-alkyl-N-arylselenoamide.

When chemically sensitizing, these selenium sensitizers are added upon dissolving them in water, an independent organic solvent such as methanol and ethanol or the mixture thereof. It is preferable to add them before starting a chemical sensitization. The selenium sensitizers applicable thereto shall not be limited to a single kind thereof, but they may also be used in combination. The amount of a selenium sensitizer applicable thereto is varied so as to meet the activity thereof, the kinds and sizes of silver halide used, a ripening temperature and time and so forth. However, they may be added in an amount of, preferably, not less than $1\times10^{-8}$ mols per mol of silver halide used and, more preferably, within the range of not less than $1\times10^{-7}$ mols to $3\times10^{-5}$ mols. When making use of a selenium sensitizer, a chemically ripening temperature at that time is preferably not lower than 45° C. and, more preferably, within the range of not lower than 50° C. to not higher than 80° C. Any pAg and pH values may be selected out. For example, the effects of the invention can be obtained in a wide range of such a pH value as 4 to 9. It is more effective to carry out a selenium sensitization in the presence of a silver halide solvent.

As for a silver halide solvent applicable to the invention, the following examples thereof may be given; (a) an organic thioether such as those described in U.S. Pat. Nos. 3,271,157, 3,531,289 and 3,574,628, and JP OPI Publication Nos. 54-1019/1979 and 54-158917/1979; (b) a thiourea derivative such as those described in JP OPI Publication Nos. 53-82408/1978, 55-77737/1980 and 55- 2982/1980; (c) a silver halide solvent having a thiocarbonyl group interposed between an oxygen or sulfur atom and a nitrogen atom, such as those described in JP OPI Publication No. 53-144319/1978; (d) an imidazole; (e) a sulfite; and (f) a thiocyanate. As for the particularly preferable solvents, thiocyanate and tetramethylthiourea may be included. The amount of a solvent applicable thereto is varied according to the kinds thereof. However, in the case of thiocyanate, for example, it is preferable to add it in an amount within the range of not less than $1\times10^{-4}$ mols to not more than $1\times10^{-2}$ mols per mol of a silver halide used. A silver halide emulsion of the invention can be achieved to have a more higher sensitivity and a lower fogginess when applying a sulfur-sensitization and/or a gold-sensitization in combination, in the course of a chemical sensitization process. The above-mentioned sulfur-sensitization is usually carried out by adding a sulfur sensitizer and an emulsion is stirred for a specific time at a high temperature and, preferably, not lower than 40° C. The above-mentioned gold-sensitization is usually carried out by adding a gold sensitizer and an emulsion is stirred for a specific time at a high temperature and, preferably, not lower than 40° C. For the above-mentioned sulfur-sensitization, any known sulfur sensitizers may be used. For example, they include thiosulfate, thiourea, allylisothiacyanate, cystine, p-toluenethiosulfonate and rhodanine.

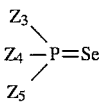

Formula (2)

wherein $Z_3$, $Z_4$ and $Z_5$ may be the same with or the different from each other and represent each an aliphatic group, an aromatic group, a heterocyclic group, —$OR_7$, —$N(R_8)$ $(R_9)$, $SR_{10}$, —$SeR_{11}$, —X or a hydrogen atom.

$R_7$, $R_{10}$ and $R_{11}$ represent each an aliphatic group, an aromatic group, a heterocyclic group, a hydrogen atom or a cation; $R_8$ and $R_9$ represent each an aliphatic group, an aromatic group, a heterocyclic group or a hydrogen atom; and X represents a halogen atom.

In formula (2), the aliphatic groups represented by $Z_3$, $Z_4$, $Z_5$, $R_7$, $R_8$, $R_9$, $R_{10}$ and $R_{11}$ represent a straight-chained, branched or cyclic alkyl, alkenyl or alkinyl group or an aralkyl group (such as methyl, ethyl, n-propyl, isopropyl, t-butyl, n-butyl, n-octyl, n-decyl, n-hexadecyl, cyclopentyl, cyclohexyl, allyl, 2-butenyl, 3-pentenyl, propargyl, 3-pentinyl, benzyl or phenethyl).

The aromatic groups represented each by $Z_3$, $Z_4$, $Z_5$, $R_7$, $R_8$, $R_9$, $R_{10}$ and $R_{11}$ each represent an aryl group having a single ring or a condensed ring (such as phenyl, pentafluorophenyl, 4-chlorophenyl, 3-sulfophenyl, a-naphthyl or 4-methylphenyl).

The heterocyclic groups represented each by $Z_3$, $Z_4$, $Z_5$, $R_7$, $R_8$, R9, $R_{10}$ and $R_{11}$ each represent a saturated or unsaturated heterocyclic group having 3 to 10 membered ring containing at least one of a nitrogen atom, an oxygen atom and a sulfur atom; (the examples thereof include a pyridyl group, a thienyl group, furyl group, a thiazolyl group, an imidazolyl group and a benzimidazolyl group.)

The cations represented by $R_7$, $R_{10}$ and $R_{11}$ represent each an alkali-metal atom or an ammonium; the halogen atoms represented by X represent each a fluorine atom, a chlorine atom, a bromine atom or an iodine atom.

$Z_3$, $Z_4$ and $Z_5$ each represent preferably an aliphatic group, an aromatic group or —$OR_1$; and $R_7$ preferably represents an aliphatic group or an aromatic group. In formula (2), the compound represents more preferably, a trialkylphosphine selenide, a triarylphosphine selenide, a trialkyl selenophosphate or a triaryl selenophosphate.

Now, the typical examples of the compounds represented by formulas (1) and (2) will be given below. However, the invention shall not be limited thereto.

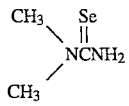

1.

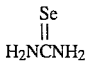

2.

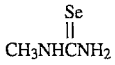

3.

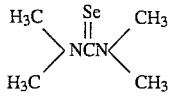

4.

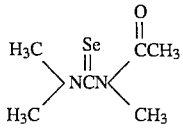

5.

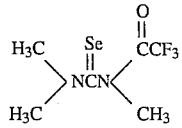

6.

-continued
7.
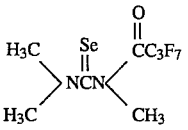
8.
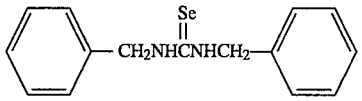
9.
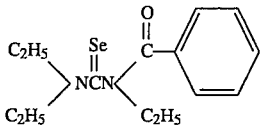
10.
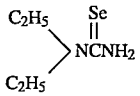
11.
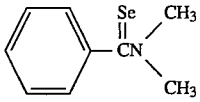
12.
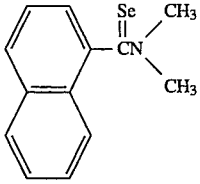
13.
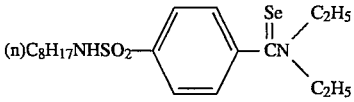
14.
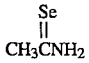
15.
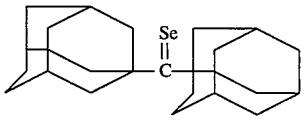
16.
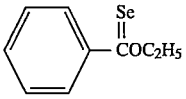
17.
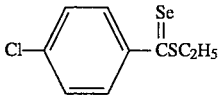
18.
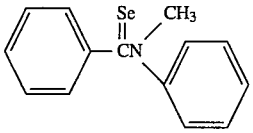
19.
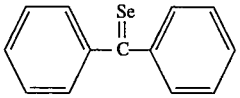
-continued
20.
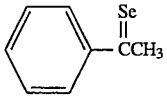
21.
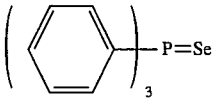
22.
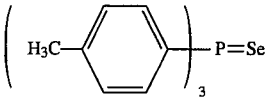
23.
$(n\text{-}C_4H_9)_3P{=}Se$
24.
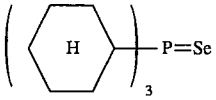
25.
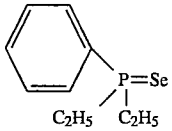
26.
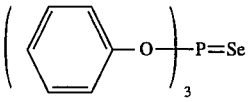
27.
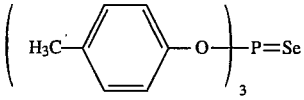
28.
$(n\text{-}C_4H_9O)_3P{=}Se$
29.
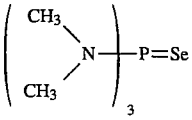
30.
$(C_2H_5O)-P{=}Se$
31.
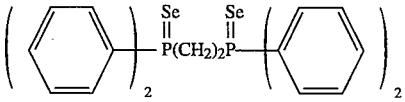
32.
$(n\text{-}C_8H_{17})_3P{=}Se$
33.
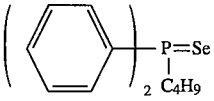

-continued

34.

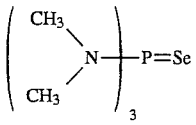

35.

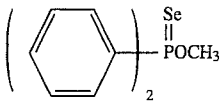

36.

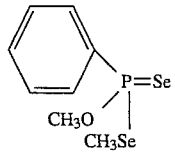

37.

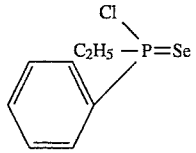

38.

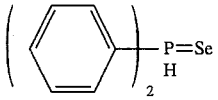

39.

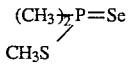

A silver halide photographic light-sensitive material relating to the invention is a one-side-coated light-sensitive material comprising a support coated on only one side thereof with silver halide having a light-sensitivity.

The silver halide composition applicable to the invention include, for example, silver bromide, silver chlorobromide, silver iodobromide and silver chloroiodobromide. Among them, the silver halide composition, comprising a silver iodobromide emulsion having not more than 10 mol % of silver iodide is preferable. Silver halide grains may have any crystal forms, and they may be in a single crystal form such as a cube, an octahedron and a tetradecahedron, or they may also be multiple twinned crystal grains having a variety of forms.

An emulsion applicable to a silver halide photographic light-sensitive material of the invention can be prepared in any known processes including, for example, the process described in Research Disclosure, No. 17643, December, 1978, pp. 22–23, "Emulsion Preparation and Types"; or the process described in ibid., No. 18716, November, 1979, p. 648.

An emulsion applicable to a silver halide photographic light-sensitive material of the invention can be prepared in a process including, for example, the process described in T. H. James, "The Theory of the Photographic Process", the 4th Ed., MacMillan Publishing Co., 1977, pp. 38–104; P. Glafkides, "Chimie et Physique Photographique", Paul Montel, 1967; or V. L. Zelikman et al, "Making and Coating Photographic Emulsion", Focal Press Co., 1964.

To be concrete, the above-mentioned emulsions can be prepared under the following conditions independently or in combination, namely; the solution conditions specified in an acidic method, an ammoniacal method, a neutral method or the like; the mixing conditions specified in a normal precipitation method, a reverse precipitation method, a double-jet precipitation method, a controlled-double-jet precipitation method or the like; and the grain-preparation conditions specified in a conversion method, a core/shell method or the like.

The average grain size of silver halide grains is to be within the range of 0.1 to 0.6 μm. It is allowed to use a monodisperse type emulsion having a narrow grain-size distribution or a polydisperse type emulsion having a wide grain-size distribution. The terms, a monodisperse type emulsion, stated herein means a silver halide emulsion having not more than 0.20 of a grain-size variation coefficient defined in, for example, JP OPI Publication No. 60-162244/1985.

A monodisperse type emulsion may be given as an emulsion comprising silver halide grains having an average grain-size larger than 0.1 μm, and at least 95 wt % of the grains are to be within ±40% of the above-mentioned average grain-size; and may also given as a silver halide emulsion having an average grain-size within the range of 0.25 to 2.0 μm, and at least 95% by number or weight of the silver halide grains thereof are to be within the range of ±20% of the average grain-size. The term, an average grain-size, stated herein means a grain diameter in the case of a spherical-shaped silver halide grain and, in the case of a grain having other shapes than a cubic and spherical-shapes, it means the diameter of a circular image obtained by converting a grain-projected image into the circular image having the same area with that of the grain-projected image.

How to prepare the above-mentioned monodisperse type emulsion has been well-known. It is detailed in, for example, J. Phot. Sci., 12, 242–251, (1963); JP OPI Publication Nos. 48-36890/1973, 52-16364/1977, 55-142329/1980 and 58-49938/1983; British Patent No. 1,413,748; and U.S. Pat. Nos. 3,574,628 and 3,655,394.

As for an emulsion applicable to a silver halide photographic light-sensitive material of the invention, it is also allowed to use an emulsion prepared, in a process for obtaining the above-mentioned monodisperse type emulsion, by making use of seed crystals and then by supplying silver ions and halide ions to the seed crystals serving as the growing nuclei so that the seed crystals can be grown up.

In an emulsion relating to the invention, the chemically ripened silver halide grains thereof may be comprised of a silver halide constitution in which the exterior and interior thereof are different from each other, or they may also have a layered structure.

The above-mentioned core/shell type emulsions can be prepared in any known process. For example, the processes described in J. Phot. Sci., 24, 198, (1976); U.S. Pat. Nos. 2,592,250, 3,505,068, 4,210,450 and 4,444,877; or JP OPI Publication No. 60-143331/1985 may be referred to.

For removing a soluble salt from an emulsion, a noodle-washing method, a flocculation precipitation method and so forth may be used. A preferable washing method may include; for example, a method described in JP Examined Publication No. 35-16086/1960, in which an aromatic hydrocarbon type aldehyde resin containing a sulfo group is used; or a desalting method described in JP OPI Publication No. 63-158644/1988, in which exemplified compound G-3 or G-8 each given therein, which serves as a macromolecular flocculant, and so forth are used.

In a hydrophilic colloid applicable to prepare a silver halide photographic light-sensitive material of the invention, a gelatin derivative such as acetylated gelatin and phthalated gelatin, a water-solubilizing cellulose derivative, or the other synthetic or natural hydrophilic polymers, besides gelatin applicable to an ordinary silver halide emulsion, may be contained.

In a silver halide photographic light-sensitive material of the invention, a variety of techniques and additives, of which have been known in the art, may be used, if required. For example, it is allowed to provide an auxiliary layer such as a protective layer, a filter layer, an antihalation layer, a crossover-light cutting layer, a backing layer and so forth, as well as a light-sensitive silver halide emulsion layer. These layers can contain the following additive in various methods; namely, a variety of chemical sensitizers, a coupler, a high-boiling solvent, an antifoggant, a stabilizer, a development inhibitor, a bleaching accelerator, a fixing accelerator, a color-mixing preventive, a formalin scavenger, a color toner, a layer hardener, a surfactant, a thickener, a plasticizer, a lubricant, a UV-ray absorbent, an anti-irradiation dye, a filter-light absorbing dye, a polymer latex, a heavy metal, an antistatic agent and a matting agent. A support applicable to a silver halide photographic light-sensitive material of the invention include, for example, those made of a polyester such as cellulose triacetate, cellulose acetate and polyethylene terephthalate; those made of a polyolefin such as polyethylene; those made of polystyrene; a baryta paper; a polyethylene or the like laminated paper; a glass plate; a metal plate; and so forth. The above-given supports may also be subbing-processed, if required.

The above-given additives are further detailed in Research Disclosure, Vol. 176, Item/17643, (December, 1978); ibid., Vol. 184, Item/18431, (August, 1979); and ibid., Vol. 187, Item/18716, (November, 1979).

For developing a silver halide photographic light-sensitive material of the invention, it is effective to use the developers detailed in, for example, T. H. James, "The Theory of the Photographic Process", the 4th Ed., pp. 291–334, and "Journal of the American Chemical Society", Vol. 73, p. 3,100, (1951).

Now, the invention will be concretely detailed with reference to the following examples.

Example 1

Preparation of Emulsions (A) and (B)

To a silver iodobromide seed emulsion having an average grain-size of 0.1 μm (and having a silver iodide content of 20 mol %) was added an aqueous ammoniacal silver nitrate solution and an aqueous potassium bromide solution using a double-jet precipitation process. The mixture thereof was grown up to have a target grain-size. In the above-mentioned process, there prepared the cubic-crystallized monodisperse type emulsions (A) and (B) having the average grain-sizes of 0.25 μm for (A) and 0.35 μm for (B) and the variation coefficient (σ/r) of 0.17 for (A) and 0.16 for (B), respectively.

Preparation of Emulsion (c)

1) Preparation of a seed emulsion

To an aqueous 0.05N potassium bromide solution containing hydrogen peroxide-treated gelatin, an aqueous silver nitrate solution and an aqueous solution containing potassium bromide same mol as the silver nitrate and, hydrogen peroxide-treated gelatin were added, while rigorously stirring at 40° C., in a double-jet precipitation process. After 1.5 minutes, the solution temperature was cooled down to 25° C. by taking 30 minutes. Aqueous ammonia (in a 28% solution) was added thereto in an amount of 80 ml per mol of silver nitrate used, and the mixture was then kept stirring for 5 minutes. Thereafter, the pH was adjusted to be 6.0 with acetic acid and, after desalting, an aqueous gelatin solution was added and the resulting mixture was redispersed.

The resulting seed emulsion was proved to be spherical-shaped grains having an average grain-size of 0.23 μm and a variation coefficient of 0.28.

2) Growth from the seed emulsion

The grains were grown up by making use of the above seed emulsion in the following manner. To an aqueous solution containing ossein gelatin and disodium polyethyleneoxy polypropyleneoxy-di-succinate, which was vigorously stirred at 75° C., an aqueous solution containing potassium bromide and potassium iodide and an aqueous silver nitrate solution were added in a double-jet precipitation process.

In the course of the above addition, pH=5.8 and pAg=9.0 were maintained. After completing the addition, the pH was adjusted to be 6.0. Thereafter, anhydrous sodium salt of 5,5'-dichloro-9-ethyl-3,3'-di-(3-sulfopropyl)oxacarbocyanine, that was served as a spectrally sensitizing dye, was added in an amount of 400 mg/mol of Ag, and a desalting was carried out in the same manner as mentioned above. After that, the desalted mixture was dispersed in an aqueous gelatin solution.

In the above-mentioned process, there prepared a tabular silver iodobromide emulsion (C) having an average silver iodide content of 1.5 mol %, a projected area diameter of 0.96 μm, a variation coefficient of 0.25 and an aspect ratio (or a ratio of a diameter of a projected area to a grain thickness) of 4.0.

While the temperature was kept constant, a dye shown in Table 1 was added to the resulting emulsion immediately before chemical ripening. Then, the resulting mixture was chemically sensitized by adding 80 mg per mole of silver of ammonium thiocyanate, 2.3 mg per mol of silver of chloroauric acid, sodium thiosulfate in an amount shown in Table 1, and a selenium sensitizer in an amount shown in Table 1. Thereafter, 4-hydroxy-6-methyl-1,3,3*a*,7-tetrazaindene was further added thereto.

To the resulting emulsion coating solution, the following additives were added. The amounts of the additives added thereto will be shown each in an amount per mol of silver halide used.

| | |
|---|---|
| Nitrophenyl-triphenylphosphonium chloride | 30 mg |
| Ammonium 1,3-dihydroxybenzene-4-sulfonate | 1 g |
| Sodium 2-mercaptobenzimidazole-5-sulfonate | 10 mg |
| 2-mercaptobenzothiazole | 1 mg |
| Trimethylol propane | 9 g |
| 1,1-dimethylol-1-bromo-1-nitromethane | 10 mg |
| $C_4H_9OCH_2CH(OH)CH_2N(CH_2COOH)_2$ | 1 g |

Comparative compounds
(Described in USP No. 2,493,748) [I]

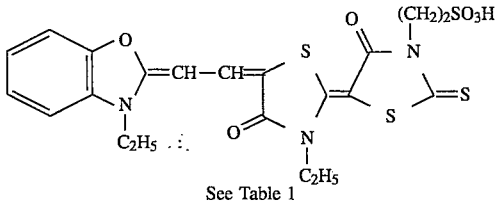

See Table 1

-continued (Described in SU-92,123) [II]

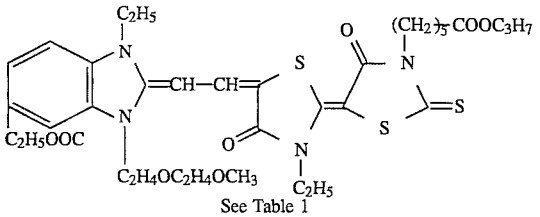

See Table 1

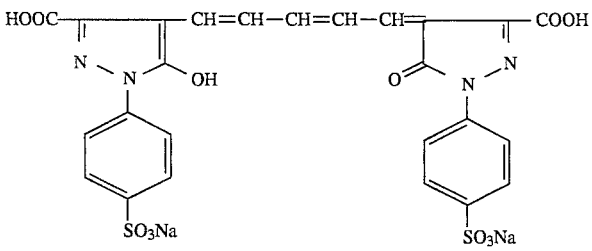

Antihalation dye-1

-continued

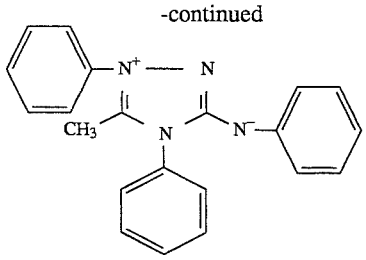

60 mg

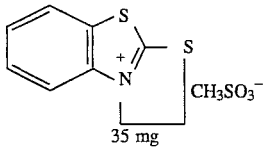

35 mg

The following additives were each added in an amount per liter of a coating solution.

| | |
|---|---|
| Lime-treated inert gelatin | 68 g |
| Acid-treated gelatin | 2 g |
| Sodium isoamyl-n-decyl-sulfosuccinate | 1 g |
| Rudox AM (colloidal silica, manufactured by DuPont) | 30 g |
| Polymethyl methacrylate particles (having an area average particle-size of 4 μm) | 0.5 g |
| An aqueous 2% solution of sodium 2-4-dichloro-6-hydroxy-1,3,5-triazine | 10 ml |
| Formalin (in a 35% solution) | 2 ml |
| Glyoxal (in a 40% solution) | 1.5 ml |

A backing-layered support was prepared in the following manner. A subbing layer was coated on both surface of a polyethylene-telephthalate support using an aqueous 10 weight % solution of glycidylmethacrylate-methylacrylate-butylmethacrylate (50:10:40:monomer ratio by weight) copolymer to obtain a subbing layered support. A coating solution for a backing layer was prepared which comprises 400 g/litre of gelatin, 2 g/litre of polymethylmethacrylate having an average particle diameter of 6 μm, 24 g/litre of potassium nitrate, 6 g/litre of sodium dodecylbenzenesulfonate, 20 g/litre of anti-halation dye-1 given below, and glyoxal. A coating solution for a protective layer was prepared which comprises gelatin, a matting agent, glyoxal, and sodium dodecylbenzenesulfonate. Using the above prepared coating solutions, the backing layer and the protective layer were coated in order on one side of the subbing-layered support to obtain a backing-layered support.

The amounts coated on the backing and protective layers were each 2.0 g/m$^2$ in terms of the amount of gelatin coated thereon.

A sample was prepared by simultaneously coating the above-mentioned emulsion-coating solution and protective-layer coating solution on the above obtained support, by making use of a slide-hopper. The amount thereof coated was 3.0 g/m$^2$ converted into the silver amount. The gelatin content was 2.5 g/m$^2$ in the emulsion layer and 1.2 g/m$^2$ in the protective layer.

With each of the samples thus prepared, the photographic characteristics were evaluated. The evaluation methods were as follows.

<Sensitometry and latent-image progression/regression)

The photographic characteristics of the samples were evaluated with a 14×17-inch film on which a wedged image was exposed using a 633 nm He-Ne laser beam and a 670 nm semiconductive laser beam. The samples were processed through an automatic processor SRX-502 using developer XD-SR and fixer XF-SR (each manufactured by Konica Corp.), at a development temperature of 35° C. for 45 seconds. The samples were processed with 30 seconds, 60 seconds or 300 seconds of the interval between exposure and development, and the latent-image progression and regression of the samples were evaluated.

Regarding the sensitivities to the beam of 633 nm shown in Table 1, each sensitivity is shown as a relative value to that of Comparative Sample No. 7 regarded as a standard value of 100 (that was processed in 30 seconds of the interval from exposure to development). Each sensitivity to the beam of 670 nm is shown as a relative value to that of Comparative Sample No. 7 regarded as a standard value of 100 (that was processed in 30 seconds of the interval from exposure to development).

<Color residual property>

Color residual property was visually evaluated by the following four grades on a viewing box after processing an unexposed film (in 14×17-inch size) in the above-mentioned process.

A: No color residue produced at all;

B: A few color residue produced, but a diagnosis can be made without any trouble;

C: Color residues were produced with concerned degrees from the viewpoint of diagnoses; and D: Color residues were produced so apparent that diagnoses may be troubled.

The results of the evaluation will be shown in Table 2. According to the invention, as is obvious from Table 2, a latent image can be stabilized excellently in aging from exposure to development, and a high red-sensitivity can also be obtained. In addition to the above, in the sample of the invention, a clear image can further be obtained with reducing a residual color-contamination even after completing a process.

TABLE 1

| Sample No. | Chemically unsensitized emulsion | Sensitizing dye: Dye No. | Sensitizing dye: Amount added (in mg/Ag · mol) | Sodium thiosulfate (in mg/Ag · mol) | Selenium sensitizer No. 21 (in mg/Ag · mol) |
|---|---|---|---|---|---|
| 1 | A | Comparison I | 45 | 2 | 0 |
| 2 | C | Comparison II | 45 | 2 | 0 |
| 3 | A | Comparison I | 45 | 3.1 | 4.5 |
| 4 | A | Comparison II | 45 | 3.1 | 4.5 |
| 5 | A | S-1 | 45 | 2 | 0 |
| 6 | A | S-1 | 60 | 3.1 | 0 |
| 7 | A | S-1 | 45 | 2 | 3.1 |
| 8 | A | S-1 | 45 | 2 | 4.5 |
| 9 | A | S-1 | 45 | 2 | 7.6 |
| 10 | A | S-1 | 45 | 3.1 | 3.1 |
| 11 | A | S-1 | 60 | 2 | 4.5 |
| 12 | A | S-1 | 60 | 3.1 | 3.1 |
| 13 | A | S-3 | 45 | 2 | 4.5 |
| 14 | A | S-10 | 45 | 2 | 0 |
| 15 | A | S-10 | 45 | 2 | 4.5 |
| 16 | B | S-1 | 45 | 3.1 | 0 |
| 17 | B | S-1 | 45 | 2 | 7.6 |
| 18 | B | S-1 | 45 | 3.1 | 3.1 |
| 19 | B | S-1 | 45 | 2 | 4.5 |
| 20 | B | S-1 | 60 | 3.1 | 3.1 |
| 21 | B | S-3 | 45 | 2 | 4.5 |
| 22 | C | S-1 | 45 | 2 | 4.5 |
| 23 | C | S-9 | 45 | 2 | 0 |
| 24 | C | S-9 | 45 | 2 | 4.5 |
| 25 | C | S-9 | 45 | 2 | 7.6 |

TABLE 2

| Sample No. | Time from an exposure to a development, and Sensitivity: 15 sec. 633 nm | 15 sec. 670 nm | 60 sec. 633 nm | 60 sec. 670 nm | 300 sec. 633 nm | 300 sec. 670 nm | Color residual property | Remarks |
|---|---|---|---|---|---|---|---|---|
| 1 | 43 | 49 | 36 | 39 | 19 | 21 | C | Comparison |
| 2 | 52 | 53 | 47 | 45 | 32 | 35 | D | Comparison |
| 3 | 64 | 68 | 58 | 60 | 49 | 51 | D | Comparison |
| 4 | 69 | 72 | 60 | 61 | 53 | 54 | C | Comparison |
| 5 | 74 | 70 | 69 | 66 | 58 | 49 | B | Comparison |
| 6 | 75 | 73 | 65 | 64 | 52 | 55 | B | Comparison |
| 7 | 100 | 100 | 99 | 98 | 97 | 98 | A | Invention |
| 8 | 110 | 113 | 110 | 112 | 109 | 111 | A | Invention |
| 9 | 123 | 119 | 121 | 119 | 121 | 117 | A | Invention |
| 10 | 118 | 124 | 117 | 123 | 117 | 122 | A | Invention |
| 11 | 117 | 115 | 116 | 114 | 115 | 114 | A | Invention |

TABLE 2-continued

| Sample No. | Time from an exposure to a development, and Sensitivity 15 sec. 633 nm | 15 sec. 670 nm | 60 sec. 633 nm | 60 sec. 670 nm | 300 sec. 633 nm | 300 sec. 670 nm | Color residual property | Remarks |
|---|---|---|---|---|---|---|---|---|
| 12 | 121 | 118 | 120 | 117 | 119 | 116 | A | Invention |
| 13 | 117 | 122 | 116 | 121 | 116 | 120 | A | Invention |
| 14 | 71 | 68 | 63 | 59 | 47 | 45 | B | Comparison |
| 15 | 107 | 109 | 106 | 108 | 105 | 107 | A | Invention |
| 16 | 87 | 85 | 73 | 76 | 59 | 54 | B | Comparison |
| 17 | 138 | 141 | 126 | 139 | 135 | 139 | A | Invention |
| 18 | 136 | 132 | 135 | 131 | 134 | 130 | A | Invention |
| 19 | 129 | 135 | 127 | 134 | 126 | 133 | A | Invention |
| 20 | 131 | 129 | 130 | 128 | 129 | 127 | A | Invention |
| 21 | 130 | 134 | 129 | 133 | 127 | 132 | A | Invention |
| 22 | 153 | 159 | 152 | 157 | 150 | 156 | A | Invention |
| 23 | 110 | 109 | 97 | 94 | 80 | 78 | B | Comparison |
| 24 | 116 | 171 | 164 | 169 | 163 | 168 | A | Invention |
| 25 | 163 | 164 | 162 | 162 | 161 | 162 | A | Invention |

What is claimed is:

1. A silver halide photographic light-sensitive material comprising a support and provided thereon, a light-sensitive silver halide emulsion layer containing silver halide grains, wherein said silver halide grains are chemically sensitized by a selenium compound and spectrally sensitized by a dye represented by formula (S-I):

formula (S-I)

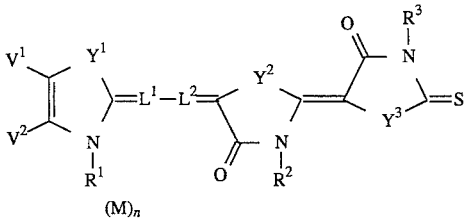

wherein $y^1$, $y^2$ and $y^3$ independently represent a —N(R)— group, an oxygen atom, a sulfur atom or a selenium atom; $R^1$ represents an aliphatic group having not more than 10 carbon atoms and having a water solubilizing group; R, $R^2$ and $R^3$ independently represent an aliphatic group, an aryl group or a heterocyclic ring, provided that at least two of R, $R^2$ and $R^3$ have a water solubilizing group; $V^1$ and $V^2$ independently represent a hydrogen atom, an alkyl group, an alkoxy group or an aryl group, provided that $V^1$ and $V^2$ may combine each other to form a condensed ring with an azole ring; $L^1$ and $L^2$ independently represent a substituted or non-substituted methine group; M represents an ion necessary for neutralizing a charge of the molecule; and n represents a number necessary for neutralizing a charge of the molecule.

2. The material of claim 1, wherein in formula (S-I) the aliphatic group represented by R, $R^1$, $R^2$ and $R^3$ is selected from the group consisting of a methyl group, an ethyl group, a n-propyl group, n-pentyl group, iso-butyl group, 2-propenyl group, 3-betenyl group, a benzyl group and a phenetyl group, each of which may have a substituent; the aryl group represented by R, $R^2$ and $R^3$ is selected from the group consisting of a phenyl group; the heterocyclic ring represented by R, $R^2$ and $R^3$ is selected from the group consisting of a pyridyl group, a furyl group, a thienyl group, a sulfolanyl group, a tetrahydrofuryl group and a piperidinyl group; the alkyl group represented by $V^1$ and $V^2$ is selected from the group consisting of a methyl group, an ethyl group, an iso-propyl group, an iso-butyl group, a tert-butyl group, a tert-pentyl group and a hexyl group, the alkoxy group represented by $V^1$ and $V^2$ is selected from the group consisting of a methoxy group, an ethoxy group and a propoxy group, each of which may have a substituent; the aryl group represented by $V^1$ and $V^2$ is selected from the group consisting of a phenyl group, a p-tolyl group, a p-hydroxy group and a p-methoxyphenyl group; the condensed ring formed with $V^1$, $V^2$ and an azole ring is selected from the group consisting of a benzoxazole, a 4,5,6,7-tetrahydrobenzoxazole, a naphtho[1,2-d] oxazole, a naphtho [2,3-d]oxazole, a benzothiazole, a 4,5,6,7-tetrahydrobenzothiazole, a naphtho [1,2-d]thiazole, a naphtho [2,3-d] thiazole, a benzoselenazole, and a naphtho [1,2d]selenazole; M represents a trimethylammonium ion, a triethanolammonium ion, a lithium ion, a sodium ion, a carcium ion, a halogen ion, a p-toluenesulfonate ion, perchlorate ion or a tetrafluoroboronium ion; and n represents a number of 0 to 2.

3. The material of claim 1, wherein the water solubilizing group is selected from the group consisting of a sulfo group, a carboxyl group, a phosphono group, a sulfate group and a sulfino group.

4. The material of claim 1, wherein the group having a water solubilizing group is selected from the group consisting of a carboxymethyl group, a sulfoethyl group, a sulfopropyl group, a sulfobutyl group, a sulfopentyl group, a 3-sulfobutyl group, a 6-sulfo-3-oxahexyl group, a ω-sulfopropoxycarbonylmethyl group, a ω-sulfopropylaminocarbonylmethyl group, a 3sulfinomethyl group, a 3-phosphonopropyl group, 4-sulfobutenyl group, a 2-carboxy-2-propenyl group, a o-sulfobenzyl group, a p-sulfophenetyl group, a p-carboxybenzyl group, a p-sulfophenyl group, a p-carboxyphenyl group, 4-sulfothienyl group, and 4-carboxypyridyl group.

5. The material of claim 1, wherein $R^1$ represents a sulfoalkyl group; and at least two groups of R, $R^2$ and $R^3$ independently represent a carboxymethyl group.

6. The material of claim 1, wherein the addition amount of said dye is $1\times10^{-6}$ to $5\times10^{-3}$ mol per mol of silver halide.

7. The material of claim 1, wherein the addition amount of said dye is $2\times10^{-6}$ to $2\times10^{-3}$ mol per mol of silver halide.

8. The material of claim 1, wherein said selenium compound is represented by the following formula (1) or (2):

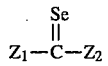

formula (1)

wherein $Z_1$ and $Z_2$ independently represent an alkyl group, an alkenyl group, an aralkyl group, an aryl group, a heterocyclic ring, —$N(R_1)(R_2)$, —$OR_3$ or —$SR_4$ wherein $R_1$ and $R_2$ independently represent a hydrogen atom, an acyl group, an alkyl group, an aralkyl group, an aryl group or a heterocyclic ring, and $R_3$ and $R_4$ independently represent an alkyl group, an aralkyl group, an aryl group or a heterocyclic ring,

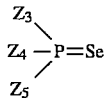

formula (2)

wherein $Z_3$, $Z_4$ and $Z_5$ independently represent an aliphatic group, an aryl group, a heterocyclic ring, —$OR_7$, —$N(R_8)(R_9)$, —$SR_{10}$—$SeR_{11}$ or —X wherein $R_7$, $R_{10}$ and $R_{11}$ independently represent a hydrogen atom, an aliphatic group, an aryl group, a heterocyclic ring or a cation, $R_8$ and $R_9$ independently represent a hydrogen atom, an aliphatic group, an aryl group, a heterocyclic ring, and X represents a halogen atom.

9. The material of claim 8, wherein $Z_1$ represents an alkyl group, an aryl group or —$N(R_1)(R_2)$ wherein $R_1$ and $R_2$ independently represent a hydrogen atom, an acyl group, an alkyl group or an aryl group; $Z_2$ represents —$N(R_1)(R_2)$ wherein $R_1$ and $R_2$ independently represent a hydrogen atom, an acyl group, an alkyl group or an aryl group; said $Z_3$, $Z_4$, $Z_5$, $R_8$, and $R_9$ independently represent an alkyl, alkenyl, alkinyl or aralkyl group which may be straight-chained, branched or cyclic, an aryl group or a saturated or unsaturated 3- or 10 membered heterocycric ring containing at least one of a nitrogen atom, an oxygen atom and a sulfur atom; and said $R_7$, $R_{10}$ and $R_{11}$ independently represent an alkyl, alkenyl, alkinyl or aralkyl group which may be straight-chained, branched or cyclic, an aryl group, a saturated or unsaturated, 3- or 10-membered heterocycric ring containing at least one of a nitrogen atom, an oxygen atom and a sulfur atom, an alkali atom or an ammonium group.

10. The material of claim 1, wherein the addition amount of said selenium compound is not less than $1\times10^{-8}$ mol per mol of silver halide.

11. The material of claim 1, wherein the addition amount of said selenium compound is $1\times10^{-7}$ to $3\times10^{-5}$ mol per mol of silver halide.

* * * * *